US005752664A

United States Patent [19]

Satake et al.

[11] Patent Number: 5,752,664

[45] Date of Patent: May 19, 1998

[54] VERTICAL GRAIN MILLING MACHINE

[75] Inventors: Satoru Satake, Tokyo; Kazuo Hironaka, Higashihiroshima, both of Japan

[73] Assignee: Satake Corporation, Tokyo, Japan

[21] Appl. No.: 812,407

[22] Filed: Mar. 5, 1997

Related U.S. Application Data

[63] Continuation of Ser. No. 629,640, Apr. 9, 1996, abandoned.

[30] Foreign Application Priority Data

May 8, 1995 [JP] Japan ..... 7-135858

[51] Int. Cl.[6] ..... B02C 7/13

[52] U.S. Cl. ..... 241/74; 241/49; 241/257.1

[58] Field of Search ..... 241/49, 57, 58, 241/74, 162, 163, 242, 247, 248, 257.1

[56] References Cited

U.S. PATENT DOCUMENTS

| | | | |
|---|---|---|---|
| 4,324,175 | 4/1982 | Satake | 99/519 |
| 5,295,629 | 3/1994 | Satake et al. | 241/57 |
| 5,394,792 | 3/1995 | Satake | 99/519 |
| 5,395,059 | 3/1995 | Satake | 241/74 |
| 5,413,034 | 5/1995 | Satake | 99/519 |
| 5,419,252 | 5/1995 | Satake | 99/519 |
| 5,511,469 | 4/1996 | Satake et al. | 99/519 |

FOREIGN PATENT DOCUMENTS

| | | |
|---|---|---|
| 373 274 | 6/1990 | European Pat. Off. . |
| 2 803 527 | 10/1978 | Germany . |
| 4-78451 | 3/1992 | Japan . |
| 5-237402 | 9/1993 | Japan . |
| 6-277531 | 10/1994 | Japan . |
| 6-327989 | 11/1994 | Japan . |

*Primary Examiner*—John M. Husar
*Attorney, Agent, or Firm*—Darby & Darby

[57] ABSTRACT

In an abrasive type vertical grain milling machine, there are mounted, on a main shaft extending generally vertically and disposed rotatably in an upright bran-removing cylinder, a screw roll for feeding grain, a plurality of abrasive milling rolls disposed below the screw roll in spaced relation to each other along the main shaft for abrading the grain, and a rotary roll disposed below the plurality of abrasive milling rolls for sending out the grain having been abraded to a grain discharge portion in such a manner that the plurality of abrasive milling rolls and the rotary roll are located within the bran-removing cylinder, a gap defined between the abrasive milling rolls adjacent to each other forming a jet-air slot, the bran-removing cylinder being communicated with a grain supply portion at an upper end thereof and with the grain discharge portion at a lower end thereof. A lower part of the bran-removing cylinder is extended downward so as to face horizontally to the rotary roll. Further, the abrasive type grain milling machine has an agitating projection provided on an outer peripheral surface of the rotary roll for agitating the grain having been abraded, and the rotary roll has a jet-air hole through which jet air is sent toward the grain being agitated by the agitating projection.

5 Claims, 5 Drawing Sheets

VERTICAL GRAIN MILLING MACHINE

This is a continuation of application Ser. No. 08/629,640, filed Apr. 9, 1996 now abandoned.

BACKGROUND OF THE INVENTION

The present invention relates to a vertical grain milling machine for milling cereal grain such as rice or wheat grain, and more particularly to an abrasive type vertical grain milling machine in which there are mounted, on a main shaft extending generally vertically and disposed rotatably in an upright bran-removing cylinder, a screw roll for feeding grain, a plurality of abrasive milling rolls disposed below the screw roll in spaced relation to each other along the main shaft for abrading and milling the grain, and a rotary roll disposed below the plurality of abrasive milling rolls for sending out the grain having been abraded to a grain discharge portion in such a manner that the plurality of abrasive milling rolls are located within the bran-removing cylinder, a gap defined between the abrasive milling rolls adjacent to each other forming or serving as a jet-air slot, the bran-removing cylinder being communicated with a grain supply portion at an upper end thereof and with the grain discharge portion at a lower end thereof.

Heretofore, this kind of grain milling machine has been proposed in an application U.S. Ser. No. 08/382,920 now U.S. Pat. No. 5,511,469 filed in this country and assigned to the assignee of this case claiming convention priority based on Japanese Patent Application No. 44916/95 (corresponding to a European Patent Application published as EP-A-0668107 on Aug. 23, 1995). A grain milling machine of this proposal will be described with reference to FIG. 4. In a vertical grain milling machine 101, a screw roll 104 and a plurality of abrasive milling or whitening rolls 105 are mounted on a main shaft 103 rotatably disposed in an upright bran-removing and grain milling cylinder 102. Gaps defined between the abrasive milling rolls 105 adjacent to each other form or serve as jet-air slots 106, and a grain milling or whitening chamber 107 which has the bran-removing cylinder 102 and the abrasive milling rolls 105 for its main parts, is communicated with a grain supply portion 108 at an upper end 107*a* thereof and with a grain discharge portion 109 at a lower end 107*b* thereof. The gaps forming the jet-air slots 106 are of the size which permits the grain to come in and out therethrough.

Now, operation of the vertical grain milling machine 101 will be described. Grain supplied to the grain supply portion 108 is fed to the grain milling chamber 107 by means of the screw roll 104. In the grain milling chamber 107, the grain is subjected to a grain milling or whitening action caused by rotation of the abrasive milling rolls 105, and the grain also enters the gaps forming the jet-air slots 106 where it is subjected to the grain milling action as well, with the result that the grain is milled or whitened. The grain having been milled is discharged through the grain discharge portion 109, while dust including bran produced as a result of the grain milling action is discharged outside the machine through perforations of the bran-removing cylinder 102 by virtue of the air jetted through the jet-air slots 106.

In the above-described conventional vertical grain milling machine, removal of bran is performed by virtue of the air jetted through the jet-air slots 106, and however bran powder still adheres (remains) slightly on the surface of the grain discharged through the grain discharge portion 109, resulting in incomplete removal of bran. Namely, by the milling action attributed to the abrasive milling rolls 105, the surface layer portion of the grain is abraded so that the bran layer is removed satisfactorily, but a grain-to-grain rubbing is not performed among the grain so that the bran layer remaining on the surface is not entirely removed. Particularly, in case of milling wheat, the bran layer, which is the surface layer portion of wheat grain, is abraded by the abrasive milling rolls 105 except in the crease portion of the wheat grain, but the bran layer in the inner part of the crease of the wheat grain is not abraded, and therefore this bran layer can not be completely removed. Further, there is a problem that extra bran may adhere to the crease of the wheat grain. Herein, "bran layers" means the whole outer layer including inner layers such as aleurone layer as well as the outer layer like epidermis (that is, the regions other than endosperm and germ). Moreover, "bran layers" also means the bran which is not scraped from the surface of the endosperm, and "bran powder" means fine bran once scraped from the surface of the endosperm and then adhered thereto again.

The vertical grain milling machine itself, in which an abrasion milling section and a friction milling section are connected in series with respect to the direction of flow of grain, is disclosed, for example, in Japanese Patent Unexamined Publication Nos. 6-277531(A), 6-3278989(A), 5-237402(A) and 4-78451(A).

However, in the vertical grain milling machines disclosed in these publications, one bran-removing cylinder does not receive therein both abrasive milling roll and rotary roll entirely, but there is a possibility that a large space in the longitudinal (vertical) direction for the friction milling section, or that the abrasion milling section partly projects radially outwardly to a large extent (in the case of Japanese Patent Unexamined Publication No. 6-277531).

The present invention has been developed in view of the above problems, and an object of the invention is to provide a vertical grain milling machine by which bran layer or bran powder adhered to surface portion of grain can be positively removed.

According to the present invention, the above object can be achieved by an abrasive type vertical grain milling machine in which a lower part of a bran-removing cylinder is extended downward so as to face horizontally to a rotary roll, the rotary roll is provided on an outer peripheral surface thereof with an agitating projection for agitating grain having been abraded and has a jet-air hole through which jet air is sent toward the grain being agitated by the agitating projection.

In an abrasive type vertical grain milling machine according to a preferred embodiment of the invention, a water adding mechanism is provided in the vicinity of an upper end of the rotary roll for adding water to the grain having been abraded and in advance of agitation by the agitating projection.

In an abrasive type vertical grain milling machine according to a preferred embodiment of the invention, the water adding mechanism includes a plurality of water adding ports formed in the rotary roll in the vicinity of the upper end thereof. Preferably, the water adding mechanism includes a water receiving concave portion formed in an upper end surface of the rotary roll, and the water receiving portion is formed in an outer peripheral wall thereof with the water adding ports extending to the outer peripheral surface of the rotary roll.

In an abrasive type vertical grain milling machine according to a preferred embodiment of the invention, the rotary roll supports a lowermost abrasive milling roll set thereon directly. Preferably the rotary roll is formed in a cylindrical shape with a lower end thereof opened, and supports the lowermost abrasive milling roll at a boss portion fitted on the main shaft and an outer peripheral portion thereof.

Grain supplied to a grain supply portion is fed into the bran-removing cylinder by means of the screw roll. In the bran-removing cylinder, surface layer portion of the grain is abraded by the abrading action caused due to rotation of the abrasive milling rolls. At this time, the grain is milled with almost all the surface layer portion thereof removed or peeled off, but part of the surface layer portion of the grain is not abraded and left untouched. The grain with the partly remaining bran layer is sent to a region around the rotary roll located in the vicinity of the lower end of the bran-removing cylinder and equipped with the agitating projection. At this time, in order to promote or accelerate the separation of bran layer and endosperm, water is added to the grain through the water adding ports, and further the grain is agitated by the agitating projection on the rotary roll. Owing to the agitation, the grain is subjected to a grain-to-grain rubbing against each other, with the result that the bran layer and bran powder remained partly on the surface portion of the grain are easily scraped with the added water. The grain having been milled is discharged through a grain discharge portion, while dust including bran produced as a result of the milling action is collected and discharged outside the machine by the jet air from the jet-air slots and jet-air hole.

The foregoing and other objects, features and advantages of the invention will be made clearer from the description of preferred embodiments hereinafter with reference to attached drawings.

DETAILED DESCRIPTION OF PREFERRED EMBODIMENTS

Now, description will be given of a vertical grain milling machine according to a preferred embodiment of the present invention taking a case of milling wheat grain as an example of cereal grain.

Figure 1:
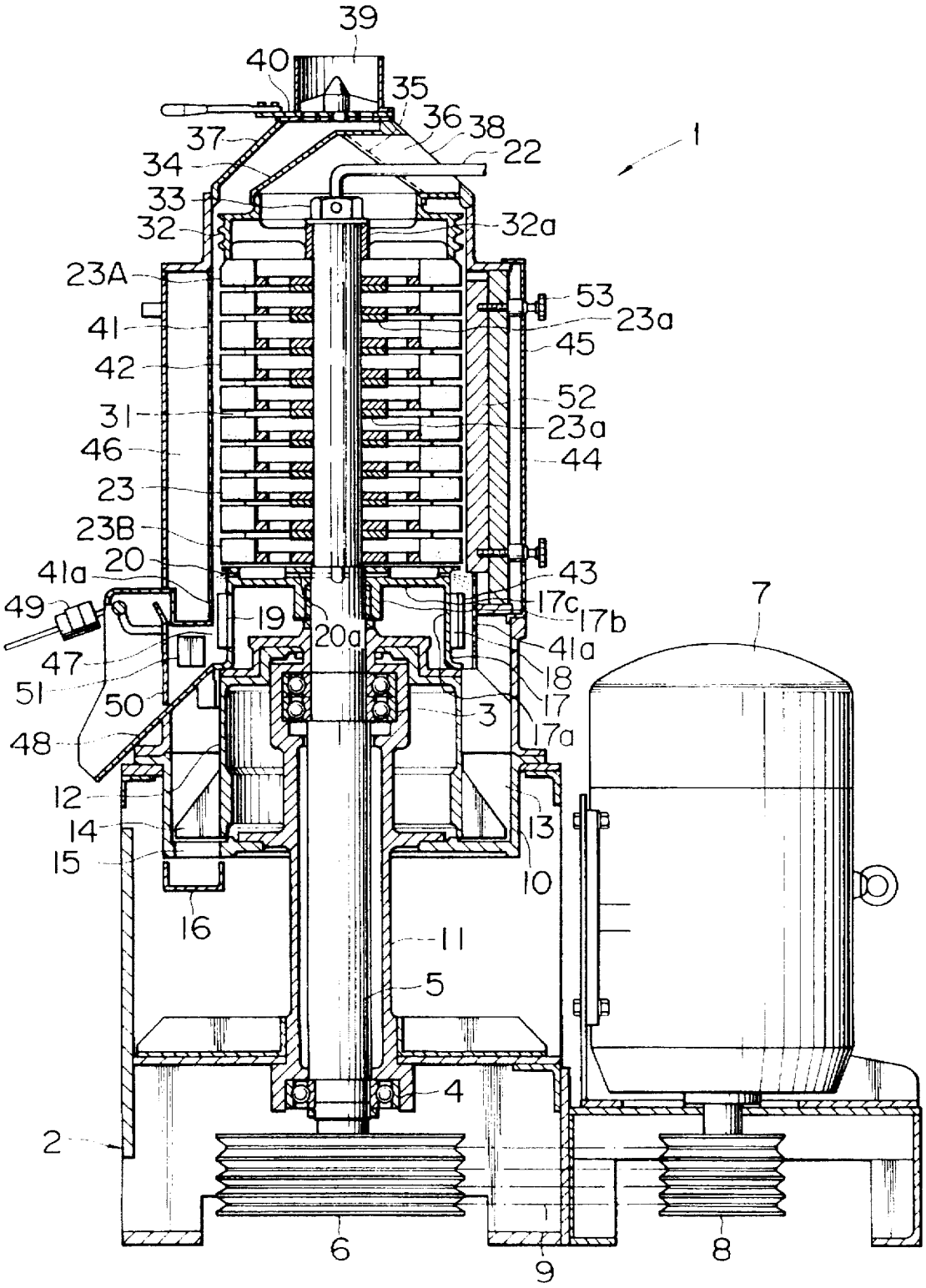
FIG. 1 is a vertical sectional view, along line I—I in FIG. 3, of vertical grain milling machine according to a preferred embodiment of the invention.

In FIG. 1 which is a general vertical sectional view of a vertical grain milling machine 1, reference numeral 2 denotes a base mount, and a main shaft 5 is supported vertically and rotatably in a generally central portion of the base mount 2 by means of upper and lower bearings 3, 4 disposed in the base mount 2. A pulley 6 is provided at a lower end of the main shaft 5 and is connected with a pulley 8 of a motor 7 by means of a V-belt 9 so that, owing to this connection, the main shaft 5 is rotated at a suitable rotating speed. The main shaft 5 is made hollow for the sake of lightweight. An upper half portion of the main shaft 5 projects upwards out of the base mount 2.

A bran-collecting cylinder 10, which is open at the top, is supported by and fixed to an upper end of the base mount 2 and a bearing cylinder 11 at a position around the upper bearing 3. Inside the bran-collecting cylinder 10, a cylindrical rotary arm 12, which is open at the bottom, is mounted on the main shaft 5, thus forming a bran-collecting chamber 13 between these members 10, 12. The rotary arm 12 is equipped on a lower peripheral surface thereof with bran scraping blades 14 which turn or rotate (circulate) within the bran-collecting chamber 13. Further, the bran-collecting cylinder 10 is formed in the bottom thereof with a bran discharge port 15 which is communicated with a bag filter and a bran-collecting fan, which are not shown, through the medium of a bran duct 16.

An agitating roll 17 serving as a rotary roll is set on the rotary arm 12. The agitating roll 17 is provided with a plurality of agitating projections 18 for agitating cereal grain in the circumferential direction of the agitating roll 17 and with a plurality of jet-air holes 19 for jetting air to the cereal grain. Further, the agitating roll 17 is formed in an upper circumferential end portion thereof with a plurality of water adding ports 20 through which water is added to the cereal grain (see FIGS. 2 and 2A). The water adding ports 20 are communicated with a pipe 22, inserted in and extending through the hollow portion of the main shaft 5, via a water receiving portion 21 and water supply ports 20*a*.

Figure 2:
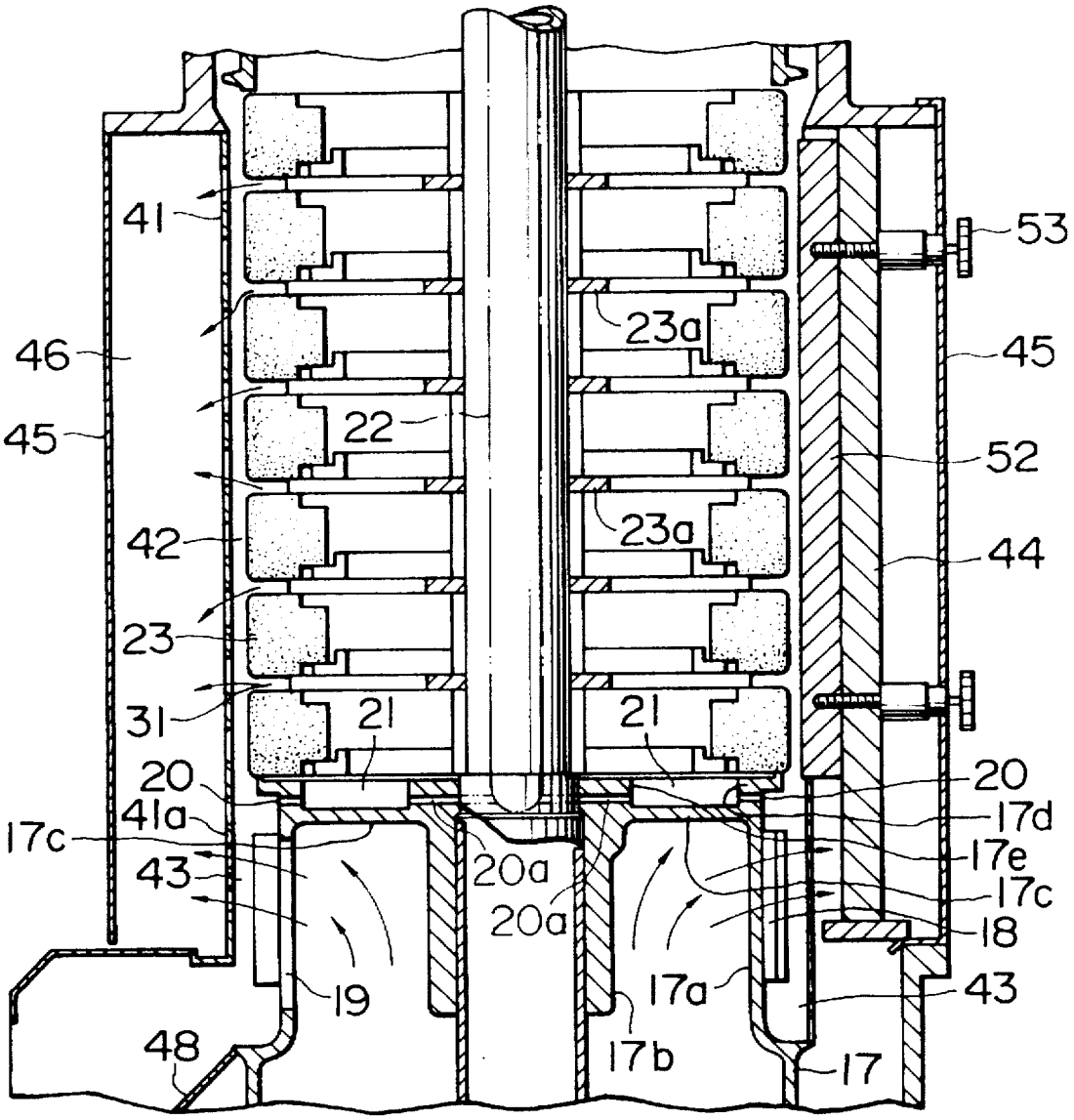
FIG. 2 is an enlarged sectional view of a part, of FIG. 1, including abrasive milling rolls for abrasion milling and an agitating roll (rotary roll) for friction milling.
Figure 2A:
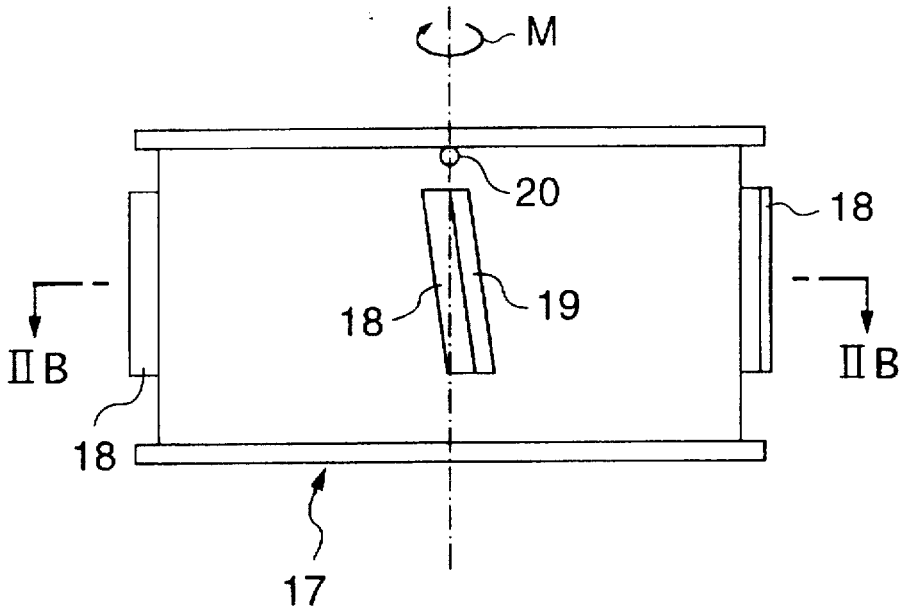
FIG. 2A is an enlarged schematic front view of agitating roll of the milling machine of FIG. 1.
Figure 2B:
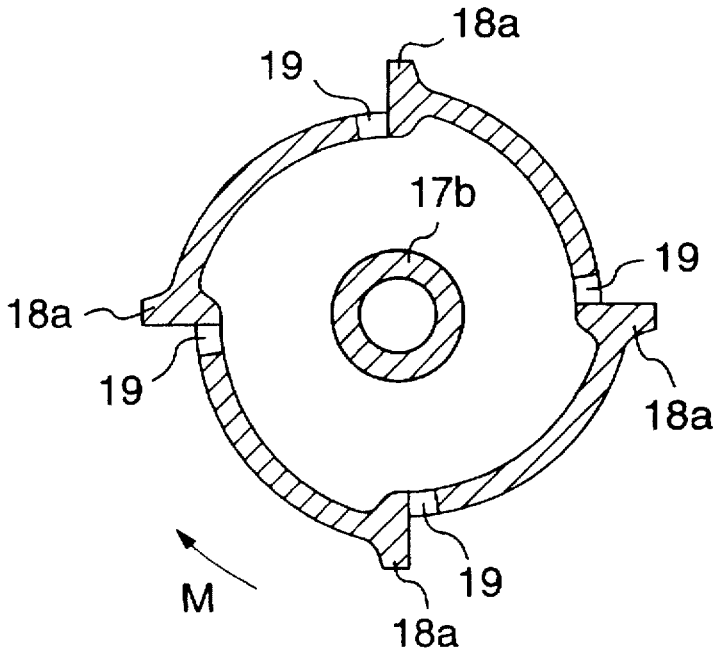
FIG. 2B is a cross-sectional view of the agitating roll along line IIB—IIB of FIG. 2A.

More specifically, the agitating roll 17 serving as the rotary roll is formed in a cylindrical shape with the lower end opened, and has a peripheral wall portion 17*a* to which the agitating projections 18 are fixed integrally therewith. The agitating projections 18 may project outwardly either simply radially or at a certain angle in the rotating direction M as shown in FIGS. 2, 2A and 2B for the purpose of effectively performing the friction milling. Each projection 18 extends along a part of helix around the peripheral wall portion 17*a* to push the grain slightly downwards upon rotation of the roll 17. The peripheral wall portion 17*a* of the roll 17 may be eccentric in cross-section as shown in FIG. 2B or may be almost circular except projection 18. The agitating roll 17 comprises a boss portion 17*b*, the peripheral wall portion 17*a* and an annular horizontal wall portion 17*c* extending radially to connect the portions 17*a* and 17*b*. Further, an extended portion (extended outer peripheral wall portion) 17*d* of the peripheral wall portion 17*a* and an extended portion (extended inner peripheral wall portion) 17*e* of the boss portion 17*b* are formed upwardly of the annular horizontal wall portion 17*c*. The inner and outer upper peripheral wall portions 17*e* and 17*d* and the horizontal wall portion 17*c* cooperatively form a concave portion 21 as the water receiving portion. The water adding ports 20 are made by holes formed in the outer upper peripheral wall portion 17*d*, while the water supply ports 20*a* for the water receiving portion 21 are made by holes formed in the inner upper peripheral wall portion 17*e*. Configurations of the agitating roll 17, agitating projection 18, water adding port 20, water receiving portion 21 and so on, as well as positions, numbers and the like of the agitating projections 18 and water adding ports 20 may be and can be changed as desired or needed.

A plurality of abrasive milling or whitening rolls 23 are set on upper end surfaces of the inner and outer upper peripheral wall portions 17*e*, 17*d* of the agitating roll 17 through a spacer 23*a* therebetween. More specifically, referring to FIG. 3, each of the abrasive milling rolls 23 is formed in a boss portion 24 thereof with a circular hole 25, through which the main shaft 5 is extended, and a key way 26. The boss portion 24 is connected with a ring portion 27 of the abrasive milling roll 23 by means of arms 28, and a plurality of draft openings 29 are formed between the boss portion 24 and the ring portion 27. An abrasion portion 30 coated with abrasive emery particles is fixed to an outer peripheral surface of the ring portion 27, and a gap between the vertically adjacent abrasive milling rolls 23 forms a jet-air slot or jet-air hole 31. The stacked structure of the abrasive milling rolls 23, as well as the function thereof, is disclosed in detail in the prior application referred to at the beginning of this specification (incorporated herein by reference thereto).

Further, the stacked structure itself and the constructions of the spacer 23 and jet-air slot or hole 31 are disclosed in detail in U.S. Pat. No. 5,395,059 incorporated herein by reference thereto.

A cylindrical screw roll 32 is set on the uppermost abrasive milling roll 23A of the plurality of abrasive milling rolls 23. A boss portion 32*a* of the screw roll 32 is held down by means of a bolt 33 screwed to an upper end of the main shaft 5 so that the screw roll 32 and the abrasive milling rolls 23 are fixed integrally on the main shaft 5. The bolt 33 is formed in the central portion thereof with a through hole (not shown) through which the pipe 22 is fitted in the main shaft 5. A hollow conical guide member 34 is connected to an upper opening of the screw roll 32. One end of an air introduction tube 36 is connected to each of a plurality of openings 35 formed in the peripheral surface of the guide member 34. The other end of the air introduction tube 36 is connected to an opening 38 formed in an upper cover 37. Further, a supply amount regulating device 40 is disposed in a grain supply port 39 provided at an upper end portion of the upper cover 37.

Meanwhile, a bran-removing cylinder 41 is provided upright around the abrasive milling rolls 23 and agitating roll 17 so as to form an upper grain milling chamber 42 a main part of which is defined between the bran-removing cylinder 41 and the abrasive milling rolls 23, and a lower grain milling chamber 43 a main part of which is defined between the bran-removing cylinder 41 (more concretely, a lower portion 41*a* of the bran-removing cylinder 41) and the agitating roll 17.

Figure 3:
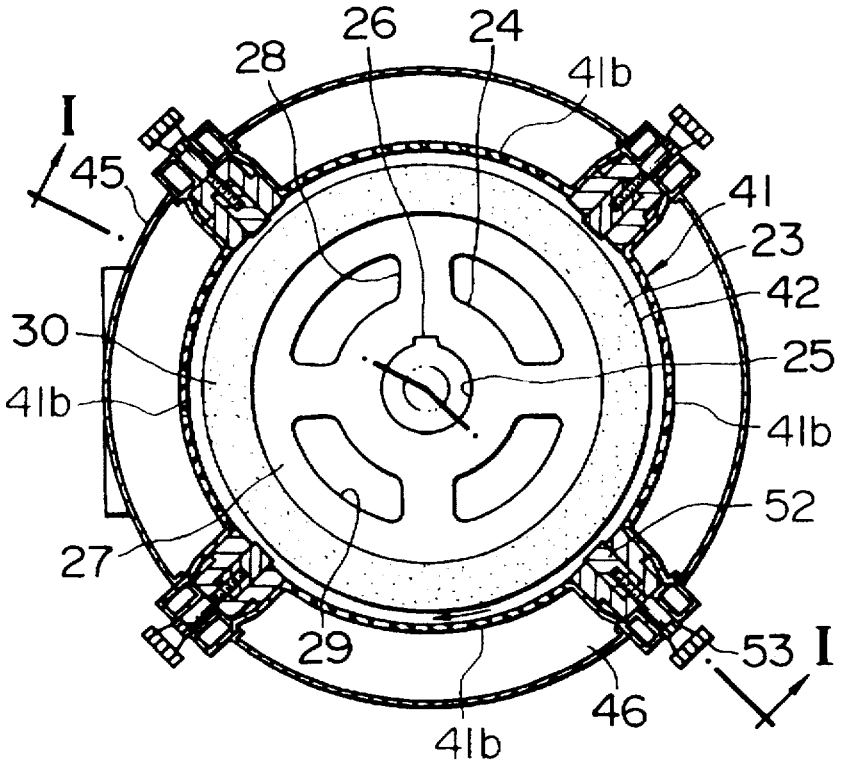
FIG. 3 is a cross-sectional view of an upper grain milling chamber of the grain milling machine of FIG. 1.
Figure 4:
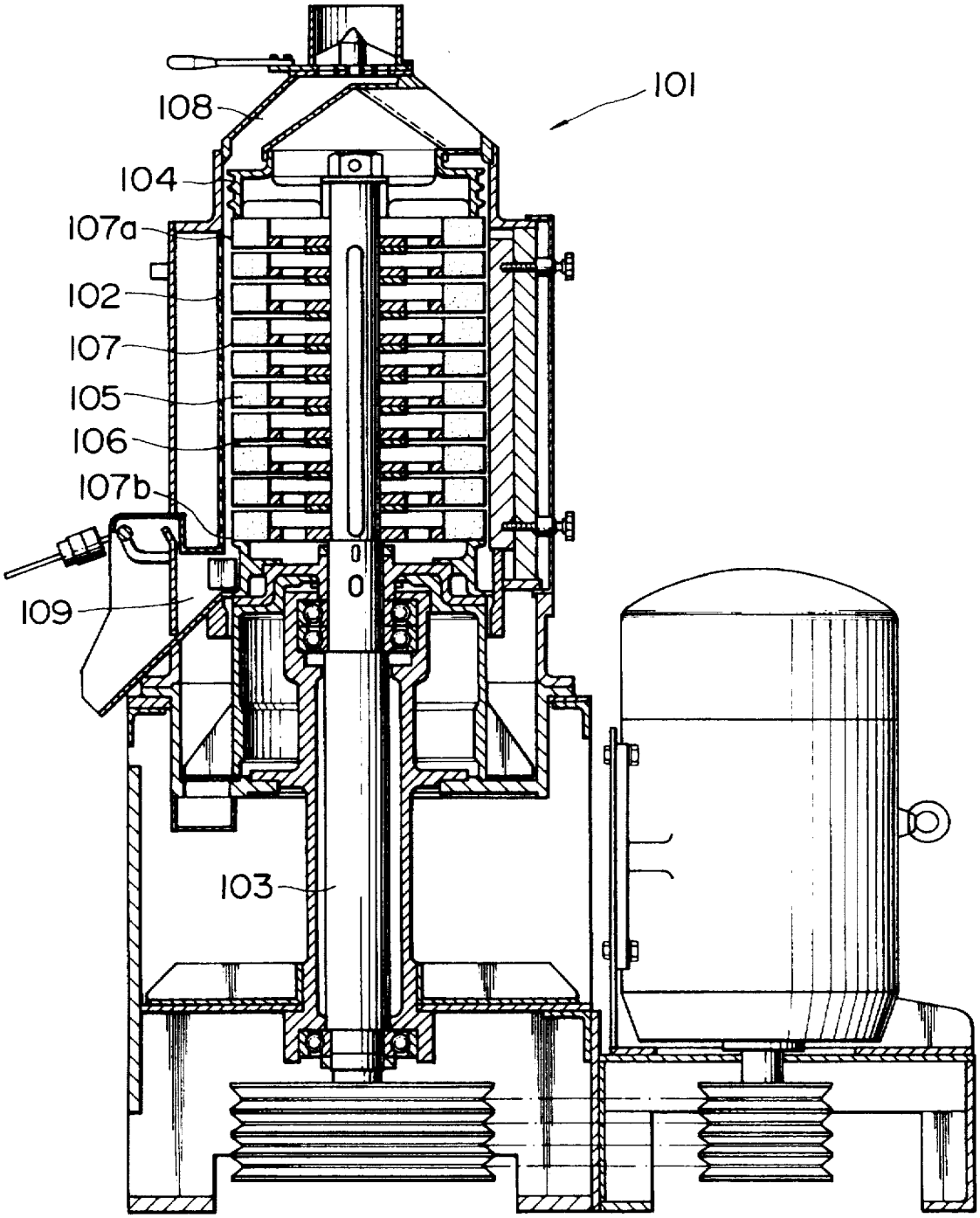
FIG. 4 is a vertical sectional view of a conventional vertical grain milling machine.

The bran-removing cylinder 41 is formed in such a manner that arcuate bran-removing cylinder members 41*b* arranged between four stanchions or support columns 44 are each supported by the stanchions 44, 44 adjacent thereto (see FIG. 3). Similarly, a bran-removing chamber 46 is formed by fitting arcuate covers 45 between the adjacent stanchions 44, respectively. The bran-removing chamber 46 is communicated with the bran-collecting chamber 13 at a lower end thereof. The construction of the bran-removing cylinder 41 is described in detail in U.S. Pat. No. 5,394,792 incorporated herein by reference thereto except for a point that the lower portion 41*a* of the bran-removing cylinder 41 is extended downwards until it faces horizontally to the agitating roll 17.

Below the bran-removing cylinder 41 is formed a grain delivery port 47 communicating with the lower grain milling chamber 43. A discharge chute 48 is connected to the grain delivery port 47, and a resistance board 50 biased toward the grain delivery port 47 by means of a weight 49 is attached to the discharge chute 48. A guide plate 51 is provided at the delivery port 47 for guiding the grain to the discharge chute 48. Further, a resistance bar 52 is loosely fitted in a concave portion formed in each of the stanchions 44. The resistance bar 52 can be moved radially inward and outward with respect to the upper grain milling chamber 42 by means of adjusting knob bolts 53. The construction of the resistance bar 52 is disclosed in detail in U.S. Pat. No. 5,413,034 incorporated herein by reference thereto.

Now, description will be given of the milling of wheat by the vertical grain milling machine 1. Raw material wheat grain, i.e. wheat grain with bran coat, is supplied from the grain supply port 39 into the vertical grain milling machine 1 at a suitable flow rate defined by means of the supply amount regulating device 40. The raw material wheat grain flows down along the slope of the guide member 34 generally uniformly in the circumferential direction and is further sent into the upper grain milling chamber 42 by means of the screw roll 32. The wheat grain in the upper grain milling chamber 42 is repelled by the peripheral edges of the rotating abrasive milling rolls 23, but they are subjected to a resistance by the resistance bars 52, and therefore the bran layer at the surface portion or outer surface of the wheat grain is abraded by the emery particles of the abrasive milling rolls 23.

Almost all the bran layer of the wheat grain is removed off while the wheat grain tumbles in the upper grain milling chamber 42, and however the bran layer in the crease of the wheat grain is not abraded and left untouched. The bran scraped from the wheat grain is removed readily from the upper grain milling chamber 42 to the bran-removing chamber 46. This is because, owing to the suction force of a fan which is not shown, the atmospheric air, passed through the air introduction tube 36, guide member 34, screw roll 32 and draft openings 29 of the abrasive milling rolls 23, is jetted through the jet-air slots 31. The bran in the bran-removing chamber 46 is conveyed through the bran-collecting chamber 13 and bran duct 16 to the bag filter which is not shown.

The wheat grain having arrived in the vicinity of the lowermost abrasive milling roll 23B in the upper grain milling chamber 42, is sent into the lower grain milling chamber 43 with the bran layer remaining partly on the surface and substantially in the crease of the grain. At this time, in order to promote the separation of bran layer from endosperm of the wheat grain, water is added to the wheat grain. The addition of water is performed in such a manner that the water supplied through the pipe 22 and supply port 20*a* to the water receiving portion 21 and stored therein, is spouted from the water adding ports 20 by a centrifugal force due to rotation of the agitating roll 17. It is desirable for promotion of the separation of bran layer to add water from the water adding ports 20 to the wheat grain at the rate of 0.3–0.4 wt. %, for example. The wheat grain thus moistened is agitated by the agitating projections 18 on the agitating roll 17 while rolling or rotating as well as revolving, thereby to cause the wheat grain to perform a grain-to-grain rubbing against each other. The grain-to-grain rubbing causes the wheat grain to be brought into contact with each other even in the crease thereof, with the result that the bran layer in the crease is scraped. The bran scraped from the wheat grain is discharged readily from the lower grain milling chamber 43 to the bran-removing chamber 46. This is also because, owing to the suction force of a fan which is not shown, air is jetted through the jet-air holes 19 to flow from the lower grain milling chamber 43 to the bran-removing chamber 46.

The wheat grain, having had the bran layer substantially completely removed and arrived at the lower end of the lower grain milling chamber 43, is guided by the guide plate 51 to be discharged through the grain delivery port 47. At this time, the wheat grain is delivered (discharged) against the resistance board 50 while being subjected to a pressing action exerted by the resistance board 50 biased by the weight 49, and therefore the interiors of the upper and lower grain milling chambers 42 and 43 can be maintained at moderate pressures.

As has been described above, in the abrasive type vertical grain milling machine 1 according to a preferred embodiment of the present invention, the surface layer portion of the grain is abraded by the abrasive milling roll 23 and the bran layer thereof is scraped as a result of the grain-to-grain rubbing among the grain attributed to the agitating projections 18 on the agitating roll 17 serving as the rotary roll, and therefore it becomes possible to substantially perfectly remove the bran powder adhered to the surface portion of the grain. Particularly, in case of milling the cereal grain such as wheat grain, it becomes easily possible to remove the bran layer in the crease, which has conventionally been difficult.

Further, a plurality of water adding ports 20, through which water is added to the grain in the bran-removing cylinder 41, are formed in the circumferential upper end portion of the agitating roll 17, and therefore the separation of endosperm from bran layer of the wheat grain is promoted or accelerated in case of milling the wheat grain, thereby facilitating the grain milling operation.

What is claimed is:

1. An abrasive type vertical grain milling machine in which there are mounted, on a main shaft extending generally vertically and disposed rotatably in an upright bran-removing cylinder;

a screw roll for feeding grain;

a plurality of abrasive milling rolls disposed below said screw roll in spaced relation to each other along said main shaft for abrading the grain and within said bran-removing cylinder, adjacent abrasive milling rolls having a gap therebetween;

a rotary roll having an upper end and being disposed below said plurality of abrasive milling rolls for sending out the grain having been abraded to a grain discharge portion;

a water adding mechanism located near said upper end of said rotary roll for adding water to the abraded grain;

a jet-air slot defined by the gap between adjacent abrasive milling rolls;

said bran-removing cylinder being in communication with a grain supply portion at an upper end thereof and with said grain discharge portion at a lower end thereof, wherein a lower part of said bran-removing cylinder extends downward so as to face horizontally said rotary roll;

wherein said rotary roll has on its outer peripheral surface an agitating projection for agitating the abraded grain to which water has been added; and wherein said rotary roll has a jet-air hole through which jet air is sent toward the grain being agitated.

2. An abrasive type vertical grain milling machine according to claim 1, wherein the water adding mechanism includes a plurality of water adding ports formed in the rotary roll near the upper end thereof.

3. An abrasive type vertical grain milling machine according to claim 2, wherein the water adding mechanism includes a water receiving concave portion formed in the upper end surface of the rotary roll, the water receiving portion being formed in an outer peripheral wall thereof with said water adding ports extending to the outer peripheral surface of the rotary roll.

4. An abrasive type vertical grain milling machine according to claim 1, wherein the rotary roll supports a lowermost abrasive milling roll set thereon directly.

5. An abrasive type vertical grain milling machine according to claim 4, wherein the rotary roll is formed in a cylindrical shape with a lower end thereof opened, said rotary roll supporting said lowermost abrasive milling roll at a boss portion fitted on the main shaft and an outer peripheral portion thereof.

* * * * *